US005088214A

United States Patent [19]

Jones

[11] Patent Number: 5,088,214

[45] Date of Patent: Feb. 18, 1992

[54] EXCAVATOR WEAR EDGE

[75] Inventor: Larren F. Jones, Aloha, Oreg.

[73] Assignee: ESCO Corporation, Portland, Oreg.

[21] Appl. No.: 642,390

[22] Filed: Jan. 17, 1991

[51] Int. Cl.[5] ..... E02F 9/28

[52] U.S. Cl. ..... 37/141 R; 37/142 A; 172/772.5

[58] Field of Search ..... 37/141 R, 141 T, 142 R, 37/142 A; 172/772, 772.5, 713

[56] References Cited

U.S. PATENT DOCUMENTS

| | | | |
|---|---|---|---|
| 2,870,667 | 1/1959 | Murtaugh | 37/142 R |
| 3,171,500 | 4/1962 | Dils . | |
| 3,497,973 | 3/1970 | Campbell | 37/141 R |
| 3,621,594 | 11/1971 | Hahn et al. . | |
| 3,685,177 | 8/1972 | Hahn et al. . | |
| 3,708,895 | 1/1973 | Griffith et al. | 37/142 A |
| 3,762,079 | 10/1973 | Lukavich et al. | 37/141 R |
| 3,864,853 | 2/1975 | Klett et al. | 37/141 T |
| 3,995,384 | 12/1976 | Wood . | |
| 4,129,934 | 12/1978 | Gettman . | |
| 4,290,214 | 9/1981 | Stepe | 37/141 T |
| 4,335,532 | 6/1982 | Hahn et al. | 37/142 R |
| 4,404,760 | 9/1983 | Hahn et al. | 37/142 R |
| 4,414,764 | 11/1983 | Johansson et al. | 37/142 A |
| 4,449,309 | 5/1984 | Hemphill | 37/141 R |
| 4,501,079 | 2/1985 | Hahn et al. | 37/141 R |
| 4,748,754 | 6/1978 | Schwappach . | |
| 4,932,478 | 6/1990 | Jones . | |
| 5,016,365 | 5/1991 | Robinson | 37/141 T |

FOREIGN PATENT DOCUMENTS

| | | | |
|---|---|---|---|
| 846248 | 8/1960 | United Kingdom | 37/142 R |

*Primary Examiner*—Randolph A. Reese
*Assistant Examiner*—Spencer Warnick
*Attorney, Agent, or Firm*—Tilton, Fallon, Lungmus & Chestnut

[57] ABSTRACT

A replaceable wear edge for the forward edge of an excavator such as the lip or wing and which includes a generally U-shaped wear member equipped with a generally T-shaped slot engageable with a conforming T-shaped boss on a confronting surface on the excavator, the wear member upper surface being equipped with a keeper-equipped opening for receiving a lock between the boss and wear member.

15 Claims, 4 Drawing Sheets

EXCAVATOR WEAR EDGE

BACKGROUND AND SUMMARY OF INVENTION:

This invention relates to an excavator wear edge and, more particularly, to a replaceable assembly for protecting a leading edge or edges of a bucket or like earth engaging implement.

The invention finds utility in connection, for example, with the lip and/or wings of a dragline bucket, front end loader, face shovel, etc. In many instances the bucket may be equipped with transversely spaced excavating teeth to facilitate earth penetration. In the past, many operators have found it advantageous to protect both the bucket lip between teeth and the bucket wings as well. Exemplary of this is co-owned U.S. Pat. No. 3,621,594 marketed by ESCO Corporation of Portland, Oreg., U.S.A. under the trademark "ZIPPER LIP". Another type of lip wear edge can be seen in co-owned U.S. Pat. No. 3,865,177. Other patents dealing with lip wear edges are U.S. Pat. Nos. 3,995,384 and 4,748,754. Other protective shrouds can be seen in co-owned U.S. Pat. Nos. 3,171,500; 4,129,934 and 4,932,478.

The '384 patent shows a wear edge or bit for rearward slide mounting on a pair of trapezoidal mounting parts projecting upwardly from the lip, each mounting part having underbeveled sides with which the bit mates. A rearwardly-extending tongue hooks over a side-driven sandwich pin to prevent forward movement.

The '754 patent shows a wear edge or cap for pivot mounting on an L-shaped retaining piece projecting upwardly from the lip, the cap having a recess which hooks onto the retaining piece. The cap has an opening rearward of the retaining piece for receipt of a sandwich type lock.

Both of the prior art constructions fail to achieve the conflicting goals of wear parts in excavating equipment—to be reliably locked in place during operation yet being easily replaced when worn. In particular, the ever present shock loads prevent the realization of these contradictory goals. The combination of bearing surfaces and lock permits movement of the prior art wear edges which can result in disengagement of the wear edge and deterioration of the lock.

According to the invention, these disadvantages have been overcome through the provision of a generally U-shaped wear member having a T-shaped slot in one of the legs of the U-shape for rearward sliding engagement with a complementarily shaped boss on a face of the excavator and wherein the wear member is equipped with a transversely enlarged, keeper-equipped opening adjacent the rear end for the receipt of an essentially non-compressible lock which resists forward or disengaging movement and which is not subject to deterioration due to heavy, cyclic loadings.

Other advantages and objects of the invention may be seen in the details of the ensuing specification.

BRIEF DESCRIPTION OF DRAWING:

The invention is described in conjunction with an illustrative embodiment, in the accompanying drawing, in which.

DETAILED DESCRIPTION

Figure 1:
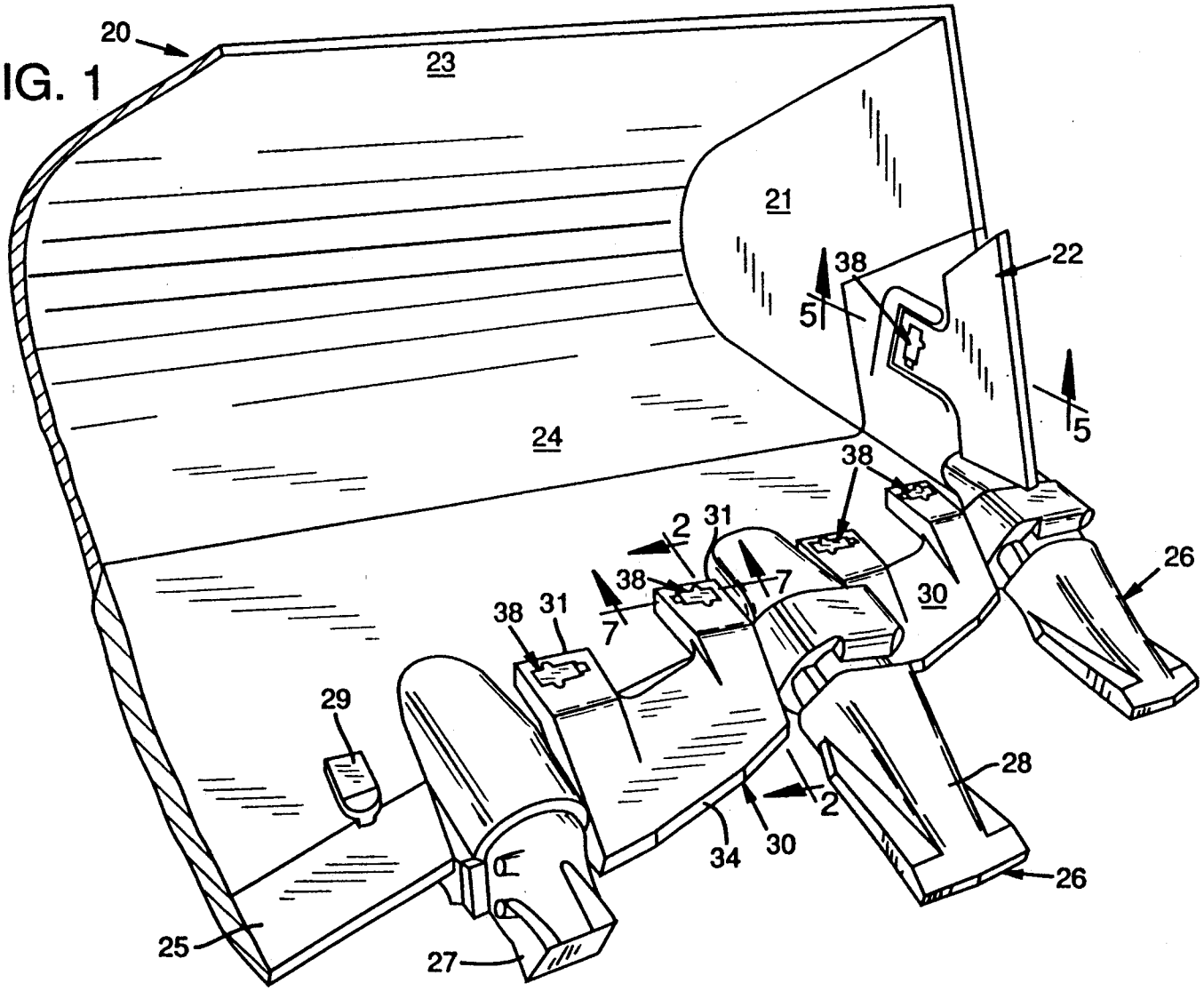
FIG. 1 is a fragmentary perspective view of an excavator bucket and showing a boss-equipped lip at the lower left.

In the illustration given and with reference first to FIG. 1, the numeral 20 designates generally a bucket having sidewalls or wings as at 21 equipped with a forwardly-facing protector 22, and a rear wall 23 merging into a bottom wall 24. The bottom wall 24 terminates in a forwardly positioned lip 25.

The lip 25 is equipped with transversely spaced-apart excavating teeth generally designated 26 (see the lower right), each of which consists of an adapter 27 fixed to the lip 25 and a point or tip 28 releasably mounted on each adapter 27. The lip 25 is protected by the invention through the use of upstanding bosses 29 (see the lower left) on which are mounted wear members generally designated 30.

LIP PROTECTOR

Figure 2:
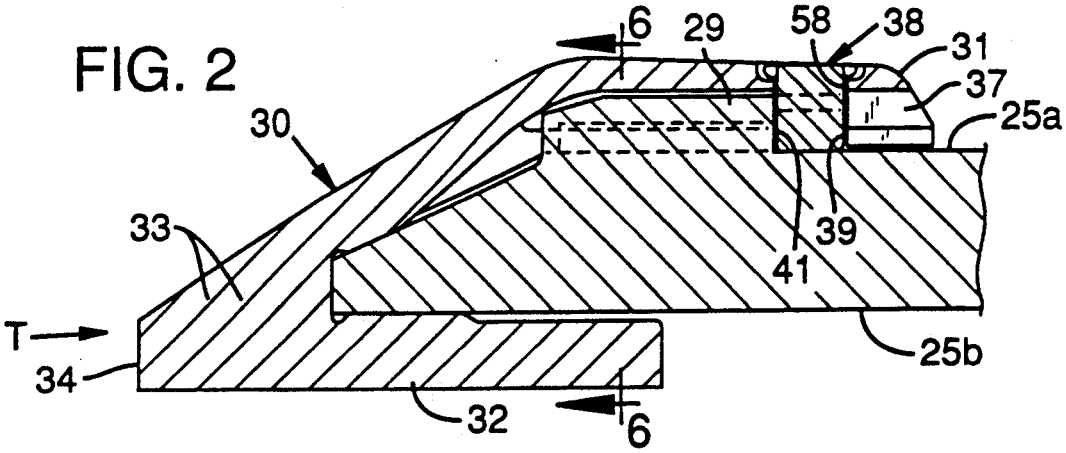
FIG. 2 is an enlarged fragmentary sectional view such as would be seen along the sight line 2-2 applied to FIG. 1.

As can be seen in FIG. 2, the wear member 30 is generally U-shaped having a longer upper or inner leg 31 in confronting relation with the upper or inner face **25*a* of the lip 25 and a lower or outer shorter leg 32 in confronting relation with the lower or outer face 25*b* of the lip 25. The legs 31, 32 are connected by a forwardly projecting connecting portion 33 which is generally aligned with the lip 25 and provides a cutting or penetrating edge as at 34 (see also FIG. 1**).

Figure 4:
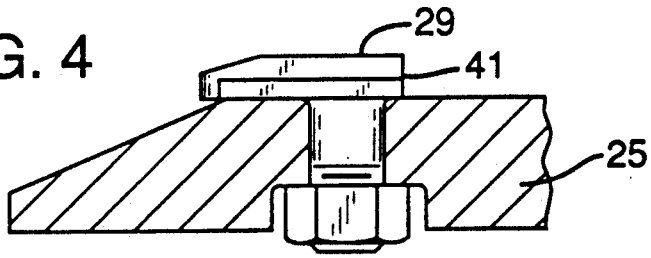
FIG. 4 is an enlarged fragmentary sectional view of a lip equipped with a modified boss.
Figure 6:
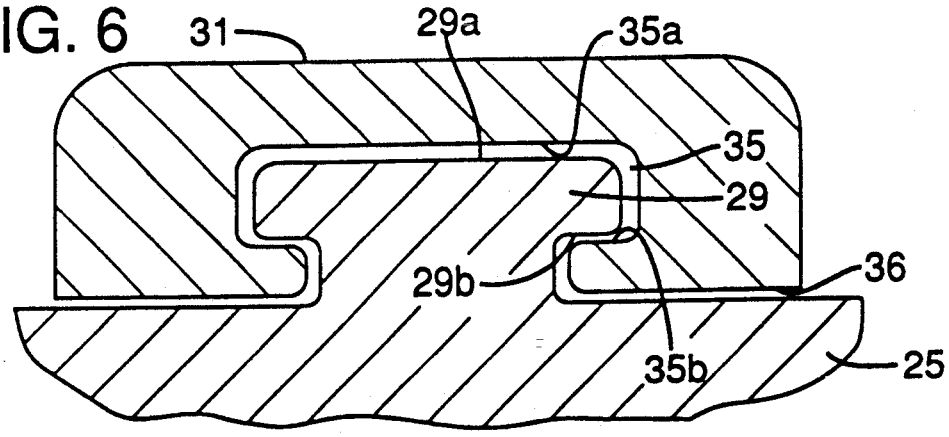
FIG. 6 is an enlarged fragmentary transverse sectional view taken along the sight line 6—6 applied to FIGS. 2 and 3.

The boss 29 (again referring to FIG. 1) is generally T-shaped and advantageously may be welded to the lip 25. Alternatively, it may be integrally cast or bolted to the upper face **25*a* (compare FIGS. 6 and 4**, respectively).

Figure 3:
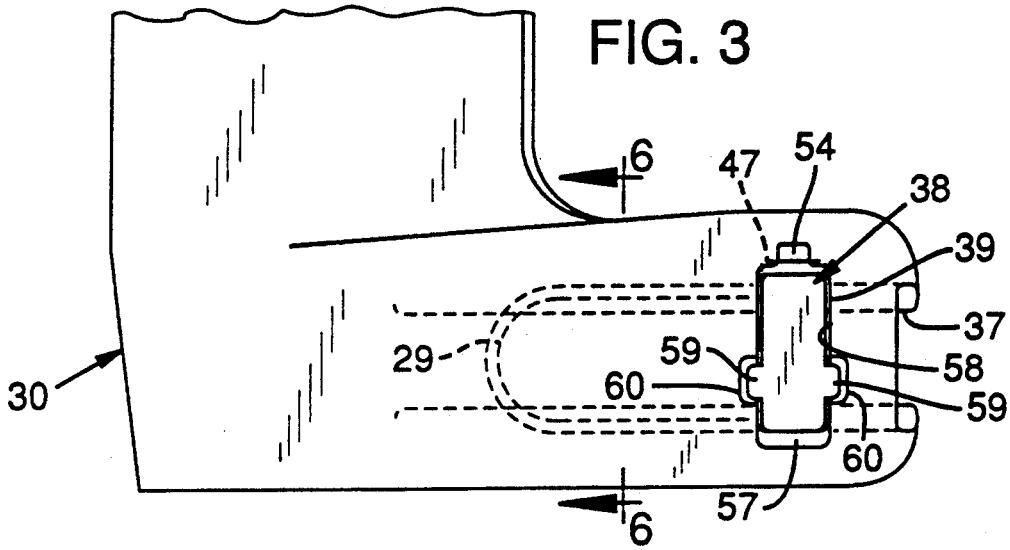
FIG. 3 is a fragmentary top plan view of the wear member of FIG. 2.

Advantageously, the wear member 30 is equipped with a spaced-apart pair of rearwardly-extending legs as at 31 in FIG. 1. Only one leg is shown in FIG. 3 but each leg 31 contains a T-shaped slot 35 (see FIG. 6) which slidably receive the bosses 29.

In other words, the bottom or inner surface 36 of the longer upper leg 31 (see FIG. 6) is equipped with the slot 35 to develop an advantageous longitudinal rearward mounting movement of the wear member 30 on the boss 29. For this purpose, the longer upper leg 31 is equipped with an opening 37 at the rear end thereof (see FIG. 3) to ensleevingly receive the boss 29.

LOCK

To accommodate the locking of the wear member 30 in place on the lip 25, a lock generally designated 38 is provided. The lock 38 is mounted in a transversely enlarged opening 39 (compare FIGS. 2 and 3 with FIG. 7) in the outer or top surface 40 of the leg 31. The opening 39 communicates with the generally T-shaped slot 35 and is positioned a spaced distance rearwardly of the cutting edge 34 and forwardly of the opening 37 so as to be aligned with the rear end 41 of the T-shaped boss 29 (see FIG. 2).

Figure 10:
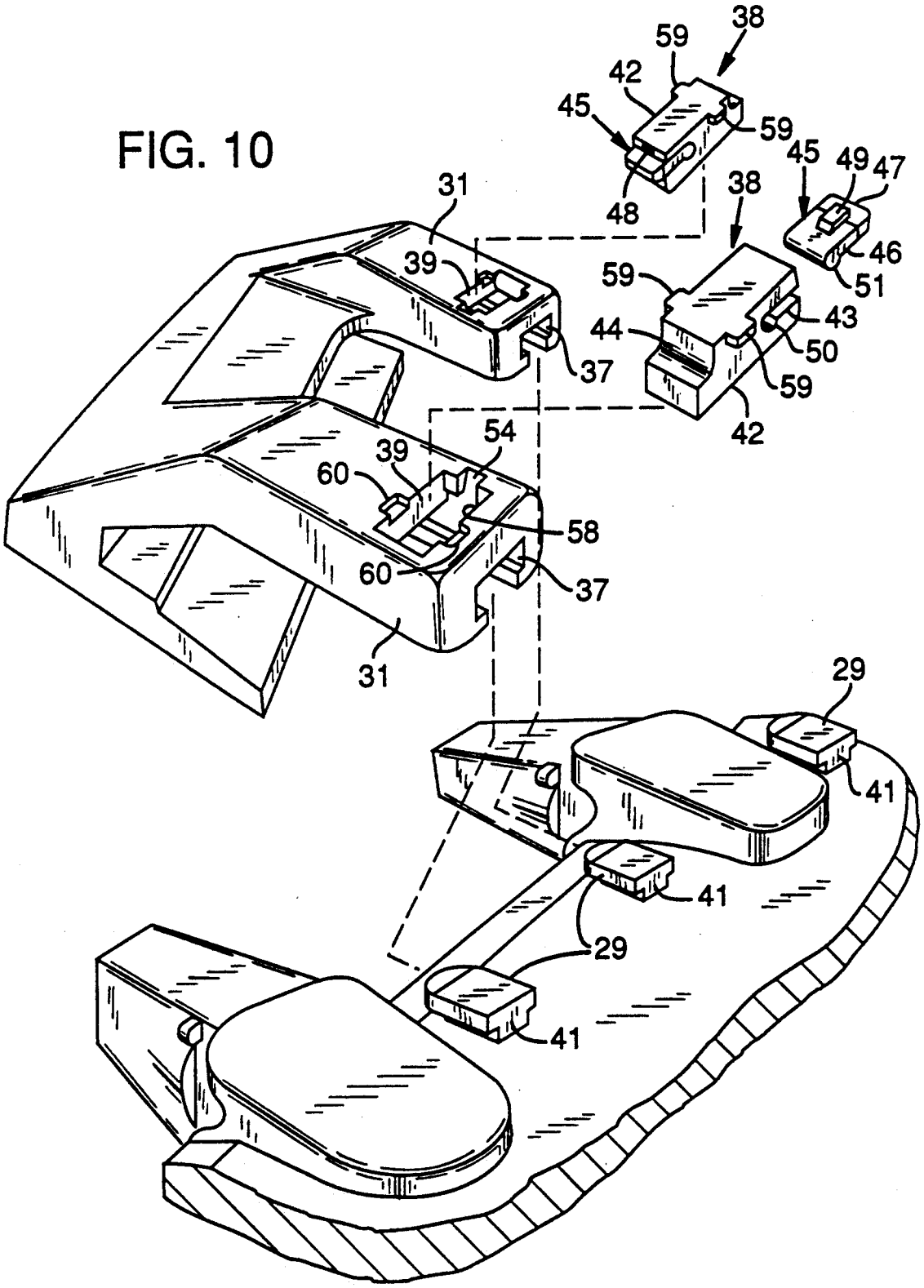
FIG. 10 is an exploded perspective view of the lock embodying teachings of the inventions.

The construction of the lock 38 can be best appreciated by first referring to FIG. 10 where a pair of unitary steel castings or blocks 42 are seen in perspective at the upper right. Each is intended to fit within the opening 39 in the fashion illustrated in FIG. 8. The lock block 42 is relatively elongated transversely of each leg 31 and is equipped with a slot 43 at one end and an arcuate surface 44 at the other end. Received within the slot 43 is the latch assembly generally designated 45 (see FIG. 8 and 10) which includes a rubber or elastomeric body 46 bonded to a steel latch element 47. The slot 43 is centrally longitudinally recessed top and bottom as at 48 (see FIG. 10) to receive upstanding and depending ribs 49 on the latch assembly 45. Additionally, the slot 43 has an inner end of partially arcuate nature as at 50 (see FIG. 10) so as to receive a similarly contoured portion 51 on the latch assembly 45. Alternatively, the lock and latch arrangement can be manufactured as one unit using a substantially non-compressible but flexible material such as rubber to be confined in the opening 39.

LOCK REMOVAL

Figure 7:
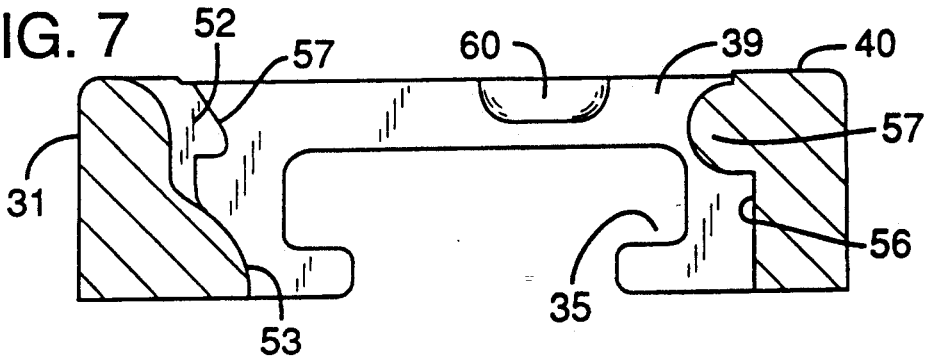
FIG. 7 is a view similar to FIG. 6, but with parts omitted and as would been seen along the sight line 7-7 applied to FIG. 1.
Figure 8:
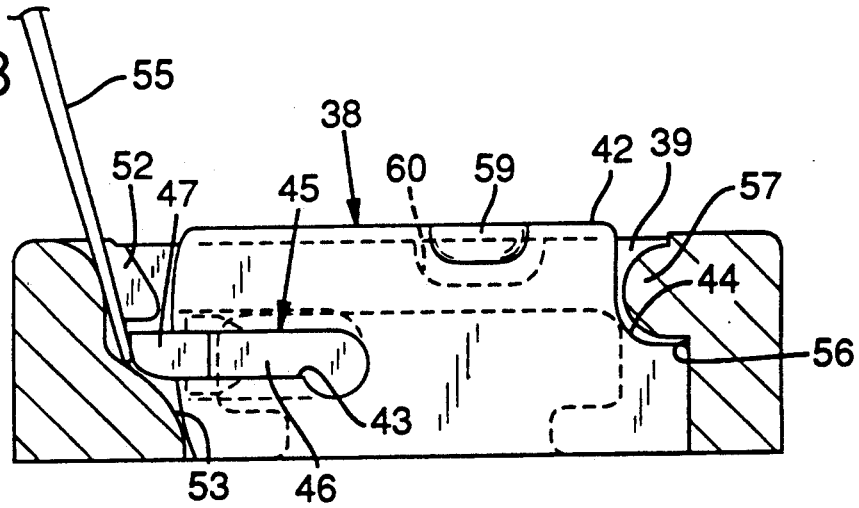
FIG. 8 is a view similar to FIG. 7 but with the inventive lock installed and in the process of removal.
Figure 9:
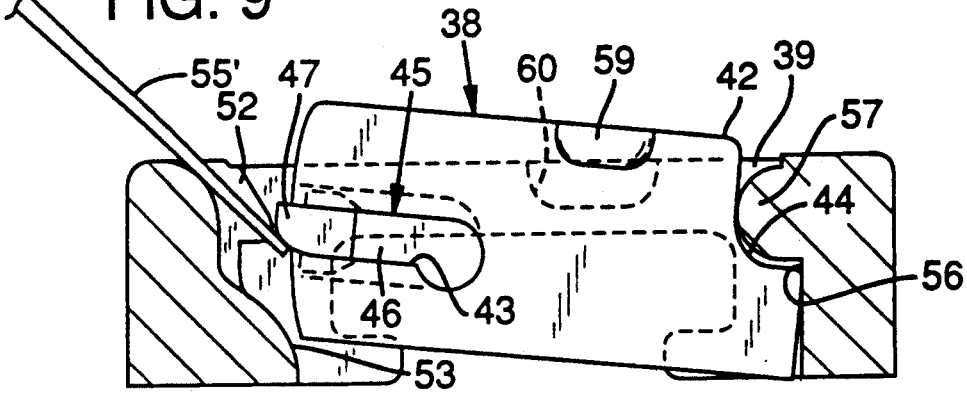
FIG. 9 is a view similar to FIG. 8 but with the lock in a subsequent position incident to removal.

The basic steps of lock removal are illustrated in FIGS. 8 and 9. In FIG. 8, it is seen that the latch element 47 is positioned under a keeper means or tab 52 provided in the confronting sidewall 53 of the opening 39 (see FIG. 7). The sidewall 53 in addition to providing the keeper means 52 is slotted as at 54 (see FIGS. 3 and 10) to permit the insertion of a screwdriver tip illustrated at 55 in FIG. 8. The other sidewall 56 of the opening 39 is equipped with an arcuate protrusion as at 57 which is normally confronted by the arcuate recess 44 of the lock block 42 so as to provide a pivot for the block 42.

Upon pivoting upward movement of the screwdriver tip to the position 55' illustrated in FIG. 9, the rubber body 46 is resiliently deformed so as to retract or upset (in effect) the latch assembly 45 and this action enables the latch element 47 to pass by the keeper means 52.

It will be appreciated that installation is the reverse of the steps illustrated—the latch assembly 45 is retracted upon engaging the ramp or sloping wall 57 (see FIG. 7) of the keeper means 52 and thereafter snaps in place as it goes "over center" past the keeper means 52 to assume the configuration depicted in FIG. 8.

In operation, the lock 38 including the block 42 and latch assembly 45 is not adversely stressed by impact loads or forces as in the prior art. The lock 38 remains confined between the rear wall 41 of the boss 29 and the rear wall 58 of the opening 39 (compare FIGS. 3 and 10). This places the steel block 42 in compression but does not affect the latch assembly 45. Any stress on the latch assembly 45 merely shifts the latch element 47 under the keeper means 52.

The block 42 is equipped with longitudinally extending flanges as at 59 (see FIG. 10) which are received within similarly contoured recesses 60 in the top wall 40 of the wear member 30 (see also FIG. 7). These elements 59-60 enable the proper positioning of the lock 38 within the opening 39.

WING PROTECTOR

The invention also finds advantageous application to the sides or wings 21 as well as other earth-engaging edges of an excavator. As previously pointed out relative to FIG. 1, the wing 21 is covered by the protector 22. A sectional view is seen in FIG. 5.

Figure 5:
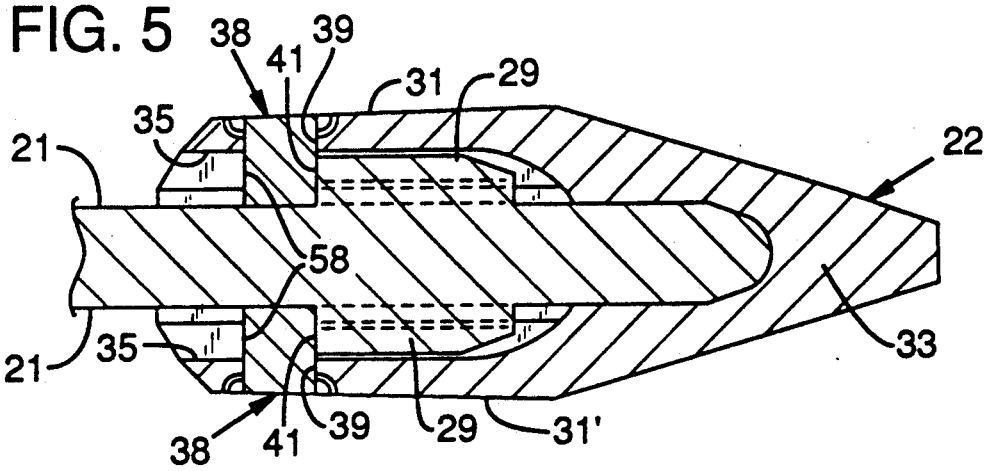
FIG. 5 is an enlarged sectional view taken along the sight line 5—5 of FIG. 1.

Referring now to FIG. 5, one of the excavator sides or wings is designated 21 and is seen to be equipped with the inventive wear member designated 22. The wear member 22 is again seen to be generally U-shaped but in this embodiment has legs 31, 31' which are substantially of the same length in proceeding rearwardly from the forward connecting portion 33—as contrasted to what might be considered a J shape in the embodiment of FIG. 2.

A difference between this embodiment and that previously described is that each leg 31, 31' is equipped with a lock generally designated 38. More particularly, each face of the wing 21 is equipped with a T-shaped boss 29 projecting laterally therefrom.

As before, the legs 31, 31' are equipped with T-shaped slots 35 for engagement with the similarly-shaped bosses 29. At o the rearward end of each boss 29, the legs 31, 31' are provided with lock-receiving openings 39 with the remainder of the locks 38 being duplicative of that described with respect to the lip protector embodiment.

OPERATION

The functioning of the two illustrated embodiments is substantially the same and, for convenience of description, the operation will be described in connection with the lip protector embodiment of FIGS. 1–10.

Under loading, the wear element 30 can be subjected to various force components and in resisting these, the invention provides advantages not found in the prior art. For example, there may be a sizable positive thrust component T—see the left hand portion of FIG. 2. With the inventive construction there is no deformation of the boss 29. This stems from the fact that this component extends longitudinally, i.e., the surfaces **29*a*, 29*b* on the boss 29 and confronting surfaces 35*a*, 35*b* in the wear member slot 35** extend longitudinally so as not to affect the bearing therebetween.

The provision of the generally T-shaped slot 35 in combination with the similarly contoured boss 29 makes possible advantageous installation and operation. By the straightforward rearward sliding movement of the wear member 30 on the boss 29, there is no need for any pivoting movement and this, in itself, makes possible for longer lower legs 32, according to intended design and usage. Also, by providing a relatively elongated bearing area between the boss 29 and the wear member 30, shock loads and other impacts can be readily transmitted from the portion 33 to the lip 25. This also provides an advantageous lateral stabilization but without the need for extensive locks or secondary surfaces.

On the other hand, there may be a substantial negative thrust, viz., a vector extending in the opposite direction to that depicted at T in FIG. 2. This is not an unusual occurrence —resulting, for example, from back drag. In such a situation, the lock 38, is subjected to compression which, in the case of the resilient locks of the prior art, results in cyclic deformation and possible premature failure.

In contrast, the invention provides for heavy loading and high compressive stresses on the lock generally designated 38 as a result of reaction forces resulting from normal operative loads at the leading edge of the wear member 30. It is because of this loading on the lock 38 that the invention provides an advantageous mounting for the lock 38 in the opening 39.

Still further, the loading on the wear element 30 may produce a vertical component, viz., one at right angles to the vector T of FIG. 2. This could result in eccentric loading on the elements of the prior art supporting the wear elements but this is not the case with the instant invention.

The invention has a boss 29 and a wear member 30 arranged so that when vertically loaded will, in contrast with prior art, minimize bending stresses in the joint between the boss 29 and the structure on which it is mounted, viz., the lip 25. When vertically loaded the inventive construction with parallel surfaces of contact primarily experiences tensile stresses at the joint between the boss and the lip.

As the wear member/lip assemblies "wear in", the wear member 30 moves rearwardly on the lip 25. The inventive arrangement allows for substantial rearward movement before the boss 29 is encountered. In contrast, the prior art wear edges had a very limited distance in which they could move rearwardly before contact with the upstanding boss or other retaining member. Engagement or contact between the wear member 30 and boss 29 in the prior art constructions could cause shear failure of the boss and/or unloading of the lock and subsequent loss of the lock. Further, in the prior art, a certain amount of preload was required to prevent lock disengagement which is a drawback avoided by the instant invention.

According to the invention, the bearing area between the wear member and boss that supports vertical loading between the parts is advantageously large so as to avoid deformation and/or abnormal wear. This feature, along with the advantageous positioning of the keeper for the laterally extending latch assembly 45 achieves both the result of avoiding disengagement by undue forward movement of the wear member 30 and deterioration of the lock 38.

SUMMARY OF INVENTION

The invention provides positive but releasable retention of a protective wear member to the leading edge of a bucket lip or bucket wings or sidewalls—these latter also having wearable edges like the bucket lip.

Exemplary of the invention is a wear member utilized to protect the leading edge of a large front end loader bucket lip. Protection of earth-engaging bucket lips is a constant maintenance problem and many forms of protection have been utilized over the years. Normally, wear edge protectors are welded, bolted, or mechanically attached. The most desirable designs are those that are mechanically attached and easy to install and remove. Although the structure is illustrated for a front end loader lip and wings, variations of this design could be utilized on face shovels, cable shovels, draglines and other earth moving equipment.

The invention includes an easily changeable wear member 30 with one or more rearwardly projecting portions or legs 31. As illustrated, the leg 31 includes a T-shaped longitudinally extending slot 35 which engages a mating or similarly contoured boss 29. The required number of bosses may either be bolted or welded to the lip or integrally cast therewith.

The wear member 30 is releasably held in position by means of a lock 38 installed in a generally rectangular opening 39 (see FIG. 3) in each leg 31. The transversely enlarged opening 39 is located rearwardly of the rear end of the boss 29. Thus, when a lock 38 is installed into each opening 39, the wear member 30 is prevented from moving off of the lip 25. Conversely, removal of each lock 38 allows easy disassembly of the wear member 30 from the lip 25.

The lock opening 39 has an arcuate protrusion 57 (see FIG. 7) at the upper edge normal to the leading edge or forward wall of the opening 39. The arcuate protrusion 57 serves as a pivot point for installation of the lock as illustrated in FIG. 9. The sidewall 53 opposite to that equipped with the arcuate protrusion 57 is equipped with a tab or keeper means 52 which retains the latch assembly 45 in place—until the rubber body 46 is deformed under the influence of a screw driver tip 55 so as to permit passage of the latch element 47 past the keeper means 52.

By providing the keeper means to the side, i.e., laterally offset from the T-shaped slot 35, the latch assembly 45 is not substantially subjected to adverse stresses yet is advantageously located for easy replacement.

While in the foregoing specification a detailed description of an embodiment of the invention has been set down for the purpose of illustration, many variations in the details herein given may be made by those skilled in the art without departing from the spirit and scope of the invention.

I claim:

1. A wear edge assembly for an excavator provided with inner and outer faces terminating in a forward edge, a rearwardly-extending generally T-shaped boss secured to one of said faces spaced rearwardly of said forward edge, a generally U-shaped wear member slidably mounted on said faces and having a pair of legs so that said wear member extends around said excavator forward edge, each of said legs having inner and outer surfaces confronting respectively said excavator inner and outer faces, at least one leg of said member having a rearwardly-extending slot in its inner surface, said slot being generally T-shaped to receive said generally T-shaped boss upon slidable, rearward movement thereon, said member one leg having a laterally enlarged opening in the outer surface thereof adjacent the rear end of said boss and communicating with said slot, said opening being defined by front, rear and side walls, and lock means in said opening confined between the rear end of said boss and the rear wall of said opening, said lock means being equipped with laterally extending latch means, and keeper means in one of said opening side walls upsettably confining said latch means whereby rearwardly exerted forces on said latch means do not affect the keeper means.

2. The structure of claim 1 in which said legs are of unequal length to provide a generally J-shaped wear member, said excavator forward edge being a horizontally-extending lip.

3. The structure of claim 1 in which said legs are of substantially the same length, said excavator forward edge being a vertically-extending wing.

4. A wear edge assembly for an excavator provided with inner and outer faces terminating in a forward edge, a rearwardly-extending, generally T-shaped boss secured to one of said faces spaced rearwardly of said forward edge, a generally U-shaped wear member slidably mounted on said faces and having a pair of legs so that said wear member extends around said excavator forward edge, each of said legs having inner and outer surfaces confronting respectively said excavator inner and outer faces, at least one leg of said member having a rearwardly-extending slot in its inner surface, said slot being generally T-shaped to receive said generally T-shaped boss upon slidable rearward movement thereon, said member one leg having a laterally enlarged opening in the outer surface thereof adjacent the rear end of said boss and communicating with said slot, said opening being defined by front, rear and side walls, and lock means in said opening confined between the rear end of said boss and the rear wall of said opening, said lock means being equipped with laterally extending latch means, and keeper means in one of said opening side walls upsettably confining said latch means, the other sidewall of said opening being equipped with an integral arcuate protrusion, said lock means having an arcuate recess in confronting relation to said protrusion for coaction therewith in installation, retention and removal of said lock means.

5. The structure of claim 4 in which said one sidewall is equipped with a tool insertion slot aligned with said keeper means.

6. The structure of claim 4 in which said latch means includes a deformable portion and a metal wedge-shaped latch element engaging said keeper means, said lock means including a metal block mounted in said opening having slot means receiving said portions, said block being equipped with said arcuate recess.

7. A wear edge assembly for an excavator provided with a lip element having upper and lower faces terminating in a forward edge, a rearwardly-extending, generally T-shaped boss secured to said upper face spaced rearwardly of said forward edge and extending rearwardly, a generally J-shaped wear member slidably mounted on said boss and having upper and lower legs with the upper leg having top and bottom surfaces, said wear member extending around said lip element forward edge, said member upper leg having a rearwardly-extending slot in its bottom surface contoured to receive said generally T-shaped boss upon slidable, rearward movement thereon, said member upper leg having a laterally enlarged opening in the top surface thereof adjacent end of said boss and communicating with said slot, said opening being defined by front, rear and side walls, and lock means in said opening confining between the rear end of said boss and the rear wall of said opening, said lock means being equipped with laterally extending latch means, and keeper means in one of said opening side walls upsettably confining said latch means whereby rearwardly exerted forces on said latch means do not affect the keeper means.

8. A wear edge assembly for an excavator equipped with a vertically-extending wing having inner and outer faces terminating in a forward edge, a rearwardly-extending, generally T-shaped boss secured to each of said faces spaced rearwardly of said forward edge and extending rearwardly, a generally U-shaped wear member slidably mounted on said bosses and having inner and outer legs, said wear member extending around said wing forward edge, each of said legs having inner and outer surfaces confronting respectively said wing inner and outer faces, each leg having a rearwardly-extending slot in its inner surface contoured to receive said generally T-shaped boss upon slidable, rearward movement thereon, each leg having a laterally enlarged opening in the outer surface thereof adjacent the rear end of said boss and communicating with said slot, each said opening being defined by front, rear and side walls, and lock means in said opening confined between the rear end of said boss and the rear wall of said opening, said lock means being equipped with laterally extending latch means, and keeper means in one of said opening side walls upsettably confining said latch means.

9. A replaceable wear member for the forwardly facing edge of an excavator, comprising:

a unitary metal member having a general U-shape in side elevation providing a pair of spaced-apart legs connected by a forward connecting portion, each leg having inner and outer surfaces, at least one of said legs having its inner surface equipped with a generally T-shaped slot extending to the rearward end of said member so as to slidingly engage a complementarily contoured boss on the excavator, said at least one leg being equipped with a laterally enlarged opening in the outer surface thereof spaced from said member rearward end and communicating with said slot and adapted to receive a locking block means, said opening being defined by front, rear and sidewalls, one of said sidewalls being equipped with a projection constituting keeper means for said locking block means whereby rearwardly exerted forces do not affect the keeper means.

10. The structure of claim 9 in which the other sidewall of said opening is equipped with an integral arcuate protrusion for pivotally installing a locking block means.

11. The structure of claim 9 in which said one sidewall is equipped with a tool insertion slot aligned with said keeper means.

12. A replaceable wear member for the forwardly facing edge of an excavator, comprising:

a unitary metal member having a general U-shape in said elevation providing pair of spaced-apart legs connected by a forward connecting portion, each having inner and outer surfaces, at least one of said legs having its inner surface equipped with a generally T-shaped slot extending to the rearward end of said member so as to slidingly engage a complementarily contoured boss on the excavator, said one leg being equipped with a transversely enlarged opening in the outer surface thereof spaced from said member rearward end and communicating with said slot and adapted to receive a locking block means, said opening being defined by front, rear and sidewalls, one of said sidewalls being equipped with a projection constituting keeper means for said locking block means, said slot having a transversely enlarged portion to provide an extension of said opening, and tab means in said transversely enlarged portion constituting said keeper means whereby rearwardly exerted forces do not affect said keeper means.

13. The structure of claim 12 in which said keeper means is equipped with a downwardly-facing surface having ends defined by said front and rear sidewalls.

14. The structure of claim 13 in which said keeper means is equipped with a tool insertion slot intermediate the ends of said downwardly-facing surface.

15. A replaceable wear member for a lip of an excavator, comprising:

a unitary metal member having a forward end and a rearward end, said member also having a general J-shaped in side elevation providing a longer upper leg and a shorter lower leg connected by a forward connecting portion and top and bottom surfaces in said upper leg, said J-shape upper leg being equipped with a generally T-shaped slot extending upwardly from the bottom surface of said upper leg and extending to the rearward end of said member so as to slidingly engage a complementarily contoured boss on said excavator lip-providing portion, said member being equipped with a transversely enlarged generally rectangular opening in said top surface spaced from said rearward end and communicating with said slot and adapted to receive a generally rectangular lock, said opening being equipped with longitudinally extending keeper means whereby rearwardly exerted forces do not affect said keeper means.

* * * * *